US007296373B1

(12) United States Patent
Hahn

(10) Patent No.: US 7,296,373 B1
(45) Date of Patent: Nov. 20, 2007

(54) APPARATUS FOR FRAMING AND HANGING A SHEET-LIKE DISPLAY ITEM

(76) Inventor: Richard L. Hahn, 1380 Lake Martin Dr., Kent, OH (US) 44240

( * ) Notice: Subject to any disclaimer, the term of this patent is extended or adjusted under 35 U.S.C. 154(b) by 212 days.

(21) Appl. No.: 11/075,145

(22) Filed: Mar. 8, 2005

Related U.S. Application Data

(60) Provisional application No. 60/551,375, filed on Mar. 9, 2004.

(51) Int. Cl.
*G09F 3/20* (2006.01)

(52) U.S. Cl. ..... 40/617; 40/658

(58) Field of Classification Search ..... 40/617, 40/600, 658, 661.01; 248/206.5; 24/303
See application file for complete search history.

(56) References Cited

U.S. PATENT DOCUMENTS

| | | | | |
|---|---|---|---|---|
| 1,738,273 | A | 12/1929 | Anderson | |
| 1,963,124 | A * | 6/1934 | Free | 40/790 |
| 2,193,928 | A | 3/1940 | Johnson | |
| 2,280,907 | A | 4/1942 | Fink | |
| 2,448,611 | A * | 9/1948 | Martin | 116/234 |
| 3,298,374 | A | 1/1967 | Grundell | |
| 3,425,147 | A | 2/1969 | Marx | |
| 3,665,628 | A | 5/1972 | Dammond | |
| 3,914,892 | A | 10/1975 | Mohr | |
| D239,998 | S | 5/1976 | Barber | |
| 4,098,014 | A | 7/1978 | Lauer et al. | |
| 4,105,127 | A | 8/1978 | Holl | |
| D250,504 | S | 12/1978 | Kliot | |
| 4,176,480 | A | 12/1979 | Euzarraga et al. | |
| 4,187,630 | A | 2/1980 | Giulie et al. | |
| 4,204,350 | A * | 5/1980 | Brenner | 40/790 |
| 4,258,493 | A * | 3/1981 | Kettlestrings et al. | 40/600 |
| 4,277,903 | A | 7/1981 | Crossot | |
| D266,380 | S | 10/1982 | Ploeger | |
| 4,356,647 | A | 11/1982 | Farris | |
| D268,242 | S | 3/1983 | Fitchett | |
| 4,459,773 | A | 7/1984 | Sandlin et al. | |
| D300,285 | S | 3/1989 | Karklins | |
| 5,044,050 | A * | 9/1991 | Trinkaus | 24/499 |
| 5,682,653 | A * | 11/1997 | Berglof et al. | 24/303 |
| D414,346 | S | 9/1999 | Houssian | |
| 6,298,591 | B1 | 10/2001 | Healy | |
| 6,305,109 | B1 | 10/2001 | Lee | |
| 6,474,009 | B2 | 11/2002 | Hahn | |
| 6,971,147 | B2 * | 12/2005 | Halstead | 24/303 |

* cited by examiner

*Primary Examiner*—Cassandra Davis

(57) ABSTRACT

An apparatus for framing and hanging a sheet-like display item on a surface includes first and second generally identical elongate members, each member having a longitudinally extending, generally U-shaped channel for receiving an edge of the sheet-like display item therein, and a retaining means enabling secure and non-marring retention of the item within the generally U-shaped channel.

3 Claims, 18 Drawing Sheets

APPARATUS FOR FRAMING AND HANGING A SHEET-LIKE DISPLAY ITEM

CROSS-REFERENCE TO RELATED APPLICATIONS

This application claims the benefit of U.S. Provisional Patent Application No. 60/551,375, filed on Mar. 9, 2004, which is hereby incorporated by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

This invention relates to framing and hanging upon walls sheet-like display items such as posters, calendars, and charts.

Sheet-like display items, e.g., posters, are often mounted upon walls and other surfaces using tacks or tape. Such mounting means are usually unattractive and detract from the display items. Further, these mounting means frequently damage the display item. Alternatively, the display items may be mounted using conventional, four-sided frames that are usually expensive. Furthermore, conventional frames are difficult and inconvenient to reuse.

SUMMARY OF THE INVENTION

It is an object of this invention to provide a new and improved apparatus for framing and hanging sheet-like display items that is attractive, relatively inexpensive, simple to manufacture, easy to assemble without tools, that does not ordinarily damage the display item while securely supporting the display item, and permits simple replacement of the display items and reuse of the apparatus. It is also an object of this invention to provide a retaining means that enables secure and non-marring retention of an article within a generally U-shaped channel.

These objects, and others, which become apparent as the specification progresses, are accomplished by the present apparatus for framing and hanging sheet-like display items that, briefly stated, comprises first and second generally identical elongate members, each member having a longitudinally extending, generally U-shaped channel, formed by a web from which first and second sides extend, for receiving an edge of the sheet-like display item. At least one pair of first and second wells, both generally cylindrical in shape, is disposed coaxially within each elongate member wherein the central axis of the wells is generally transverse to the central axis of the elongate member and perpendicular to the channel.

A retaining means is provided within each well of the elongate members for captively retaining the edges of the sheet-like display item. The retaining means comprises a magnet and a magnetic pin, e.g., a pin made from iron, steel or other metallic substance that is attracted to a magnet, both of which are preferably cylindrical in shape.

The retaining means acts to captively retain an edge of a sheet-like display item that has been inserted into the generally U-shaped channel of an elongate member as follows. After an edge of a sheet-like display item has been inserted into a channel of an elongate member, a magnet is inserted into the first well and a magnetic pin is inserted into the second well. As the magnet pin is drawn to the magnet, the edge of the sheet-like display item is securely sandwiched between the magnet and pin. Since the magnet and pin are disposed within the coaxial wells, the retaining means captively retains the edge of the sheet-like display item within the elongate member. The retaining means of the present invention can place substantial pressure on the sheet-like display item and securely hold the item within the channels of the present framing apparatus, without twisting, tearing, or otherwise damaging the sheet-like display item. Furthermore, the retaining means of the present invention is capable of securely retaining alternative display items such as tapestries. The surfaces of the magnet and/or magnetic pin that contact the sheet-like display item may be covered with a resilient and non-skid material, e.g., rubber, cork, neoprene, or vinyl, to facilitate the retention and protection of the sheet-like display item. Alternatively, the magnet and/or magnetic pin may be modified, e.g., scored or provided with a pointed tip, to facilitate retention of the sheet-like display item. In addition, decorative caps, buttons, medallions, etc., may be affixed to the magnet and/or magnetic pin.

The framing and hanging apparatus of the present invention may further comprise a front-cover member, with or without a back-cover member, that provides support and protection to the sheet-like display item. The cover members may be formed from glass, acrylic or some other similar material. The elongate members may be formed in a variety of profiles, e.g., round or square, from natural materials, e.g., wood, marble, metal, or glass, or synthetic materials, e.g., plastic. The apparatus for framing and hanging sheet-like display items may further comprise an elongate member sheath that may provide a variety of decorative features.

DETAILED DESCRIPTION OF THE INVENTION

Figure 1:
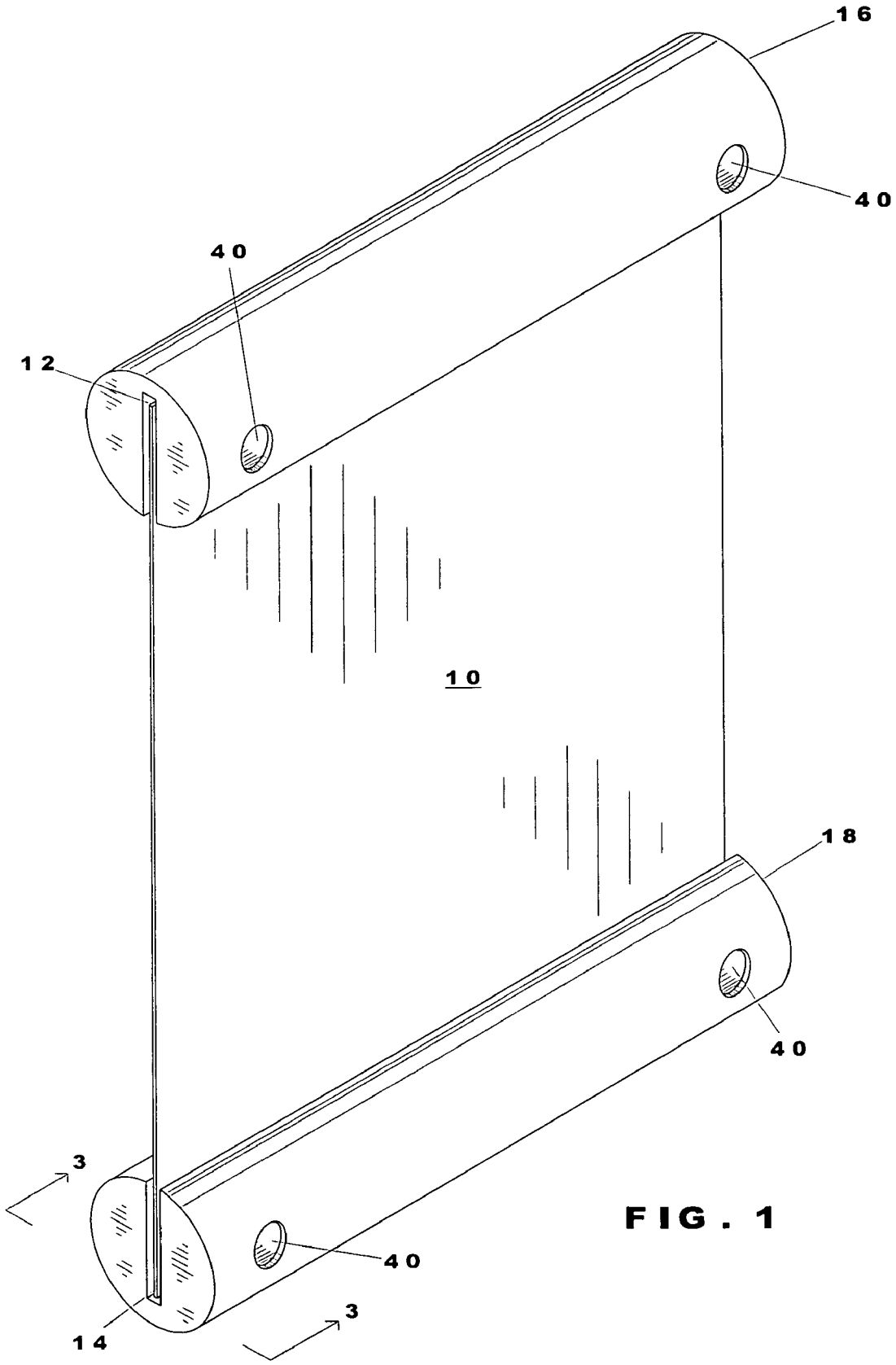
FIG. 1 is a perspective view of the apparatus for framing and hanging a sheet-like display item in accordance with the invention.
Figure 2:
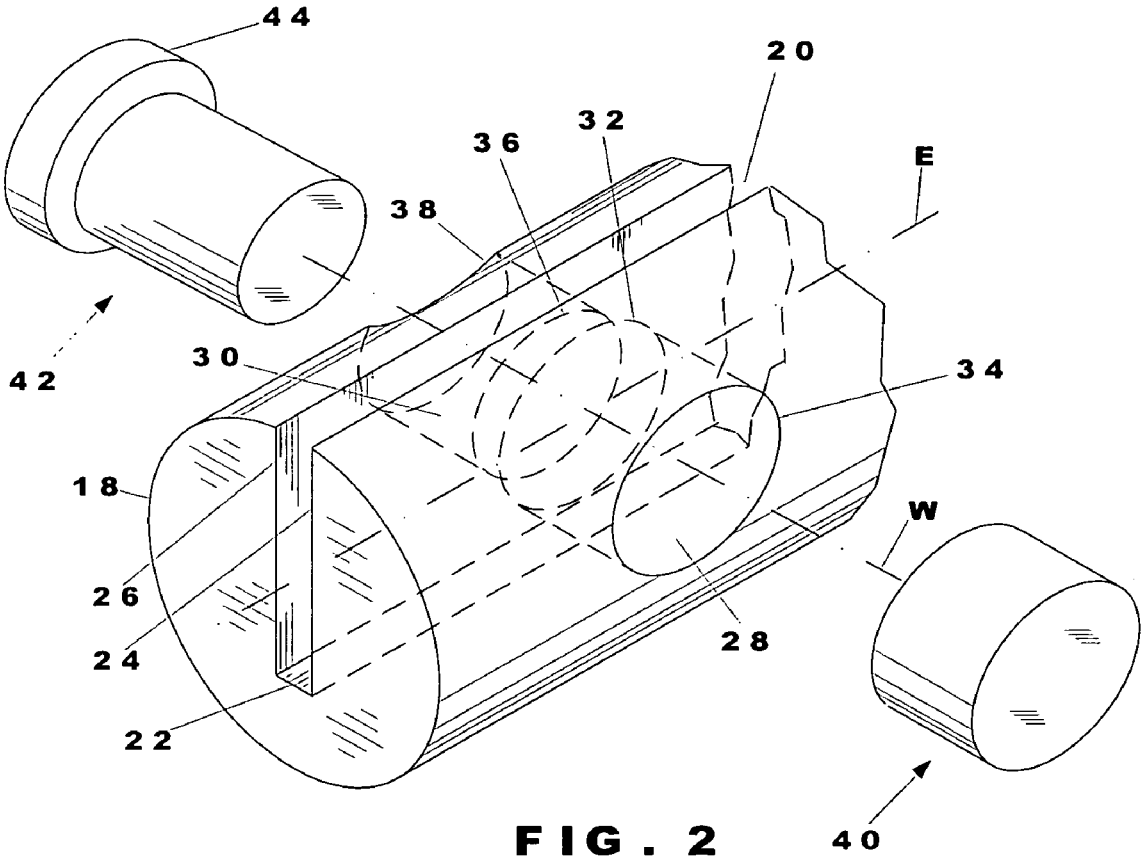
FIG. 2 is an enlarged, exploded perspective view, partially broken away, of a preferred embodiment of the second elongate member, including a retaining means, of the apparatus of FIG. 1.

Referring to the drawings, FIG. 1 shows a preferred embodiment of the present invention including a sheet-like display item 10 suspended between generally identical first elongate member 16 and second elongate member 18 attached to top edge 12 and bottom edge 14 of the sheet-like display item 10. The first elongate member 16 and second elongate member 18 have the same configuration, but are inverted with respect to each other. Accordingly, the following detailed description of the second elongate member 18 also applies to the first elongate member 16. Referring also to FIG. 2, the second elongate member 18 has a longitudinally extending, generally U-shaped channel 20 for receiving the edge 14 of the display item 10. The channel 20 is formed by a web 22 from which first side 24 and second side 26 extend. At least one pair of a first well 28 and a second well 30, both generally cylindrical in shape, is disposed coaxially within the second elongate member 18 such that the central axis W of the wells 28 and 30 is generally transverse to the central axis E of the elongate member 18 and perpendicular to the sides 24 and 26 of the channel 20. The first well 28 has a first inner opening 32 in the first side 24 of the channel 20 and a first outer opening 34 in the exterior of the elongate member 18. The second well 30 has a second inner opening 36 in the second side 26 of the channel 20 and a second outer opening 38 in the exterior of the elongate member 18. The diameter of the first well 28 is slightly larger than the diameter of the second well 30. The material used to form the elongate members 16 and 18 is preferably a solid, natural material such as wood, glass, metal, or marble. The channel 20 and cylindrical wells 28 and 30 may be introduced into the first and second elongate members 16 and 18 by conventional milling, cutting, and drilling techniques. Alternatively, the elongate members 16 and 18 may be formed from a synthetic material such as plastic. Where the elongate members 16 and 18 are formed by injection molding techniques, the channel 20 and wells 28 and 30 may be formed by an appropriate structure, e.g., ribs. The outer profile of the elongate members may be varied, e.g., round, square, etc., to provide different decorative features.

Figure 3:
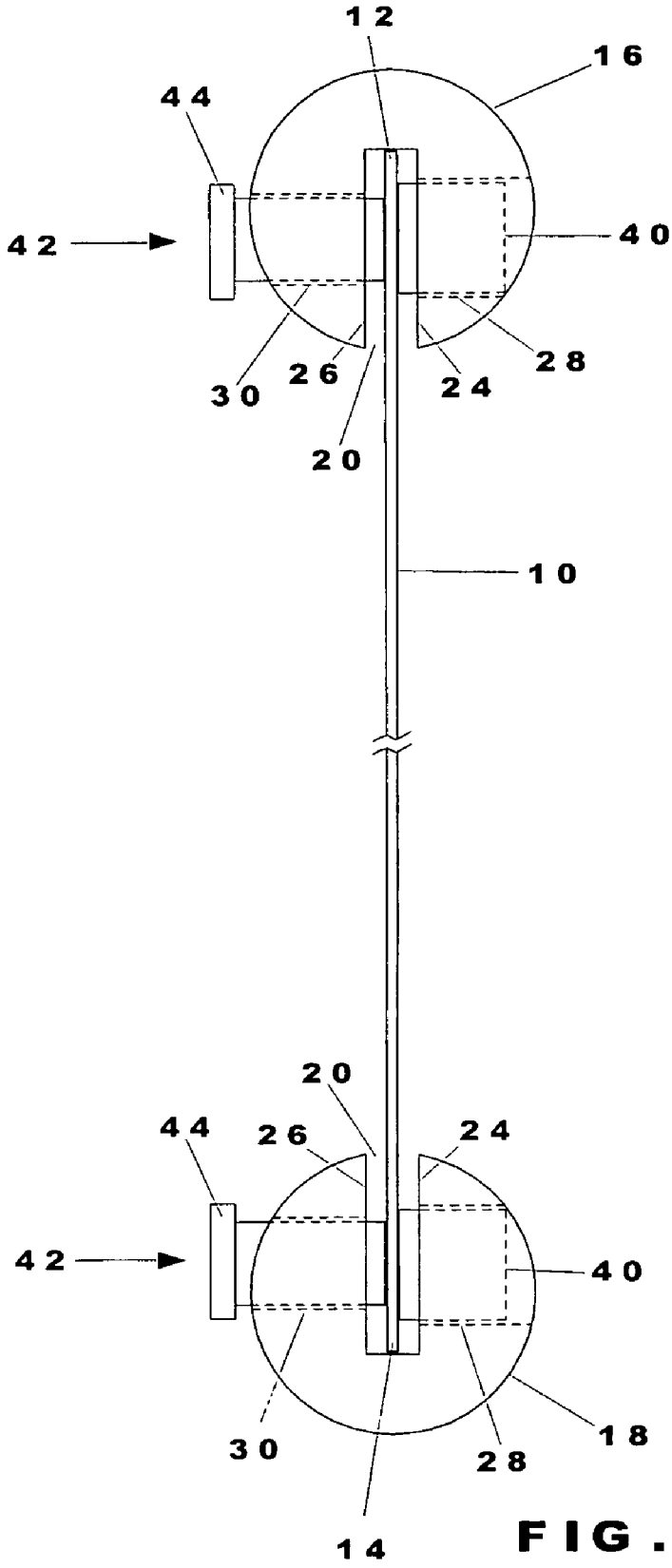
FIG. 3 is a side view of the apparatus of the present invention viewed along line 3-3 of FIG. 1.
Figure 3A:
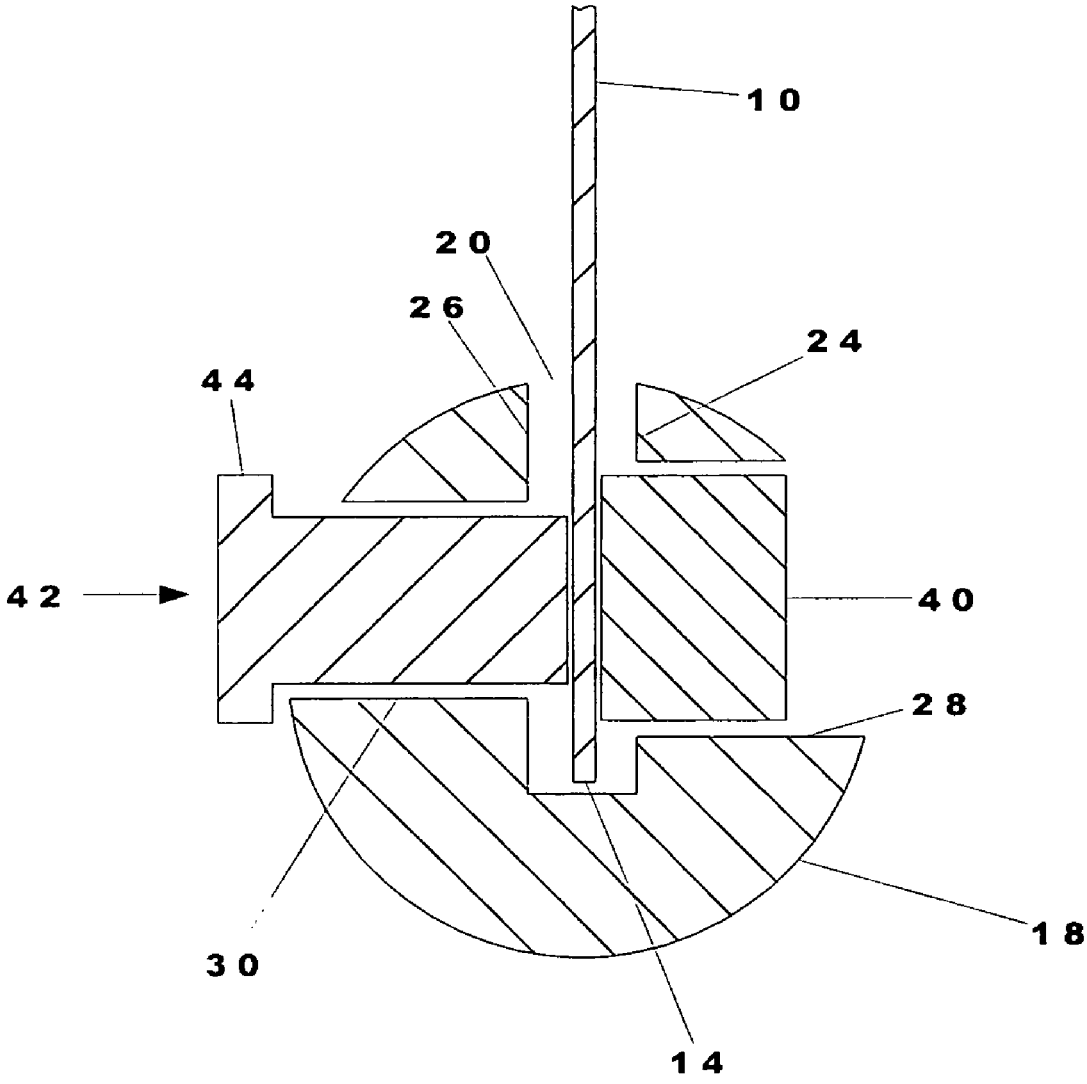
FIG. 3*a* is an enlarged, cross-sectional view of the second elongate member of FIG. 3.

FIGS. 2, 3, and 3*a* illustrate a preferred embodiment of the retaining means for captively retaining the bottom edge 14 of the sheet-like display item 10 within the elongate member 18 that includes a magnet 40 and a magnetic pin 42, both being generally cylindrical in shape. After the edge 14 of the sheet-like display item 10 is placed into the channel 20 of the elongate member 18, the magnet 40 and magnetic pin 42 are placed within the first well 28 and second well 30, respectively. As the magnet 40 and magnetic pin 42 are drawn together, the edge 14 of the sheet-like display item 10 is securely sandwiched between the magnet 40 and magnetic pin 42. The edge 14 of the sheet-like display item 10 is thereby captively retained within the elongate member 18.

The size of the magnet 40 is determined so that the magnet 40 may be easily inserted into and extracted from the first well 28. The size of the magnetic pin 42 is similarly determined with respect to the second well 30, and the magnetic pin 42 is provided with a flange 44. Further, the diameter of the magnet 40 is slightly larger than the diameter of the second well 30. This difference in size allows a user to easily separate the magnetic pin 42 from the magnet 40 when extracting the magnetic pin 42 from the second well 30. More specifically, the magnet 40, having a larger diameter than the second well 30, will be blocked by the second side 26 of the channel 20 as the magnetic pin 42 is extracted from the second well 30. Accordingly, the force of the magnet 40 is distributed against the second side 26 of the channel 20, thereby allowing separation of the magnetic pin 42 from the magnet 40 without any damage to the sheet-like display item 10. The sheet-like display item 10 may then be easily removed from the apparatus of the present invention.

Figure 4:
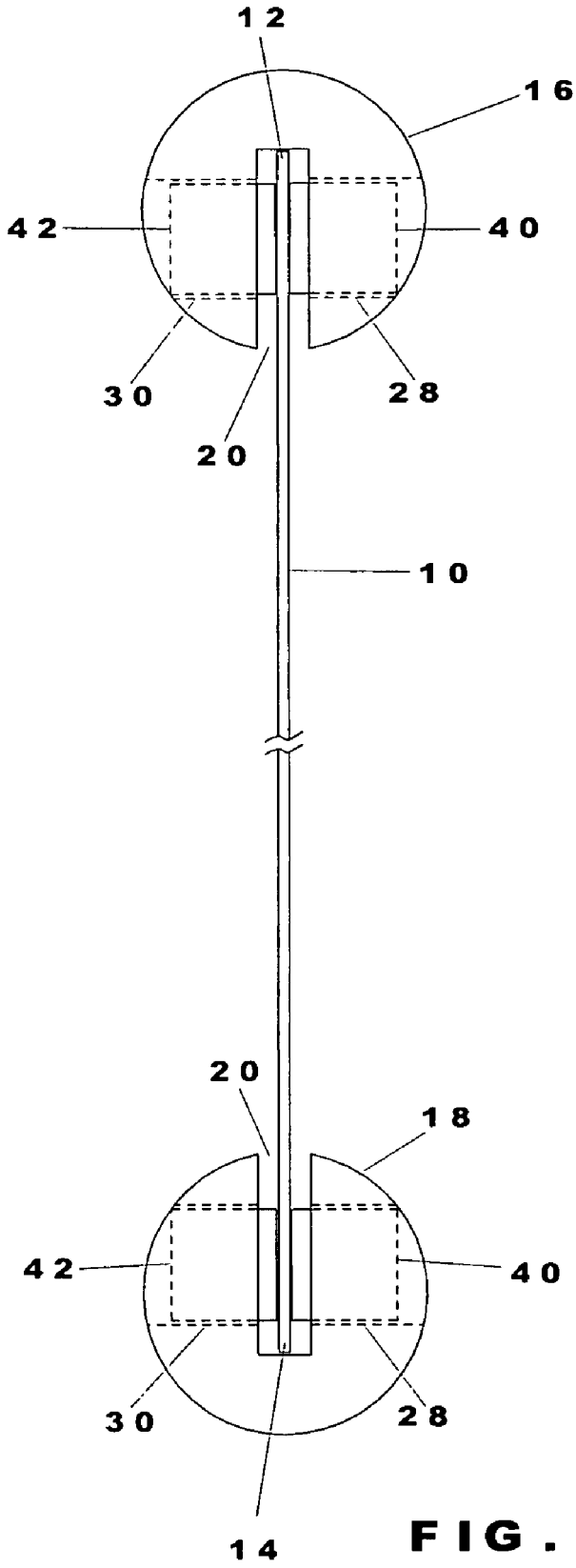
FIG. 4 is a side view of a second embodiment of the apparatus of the present invention.
Figure 4A:
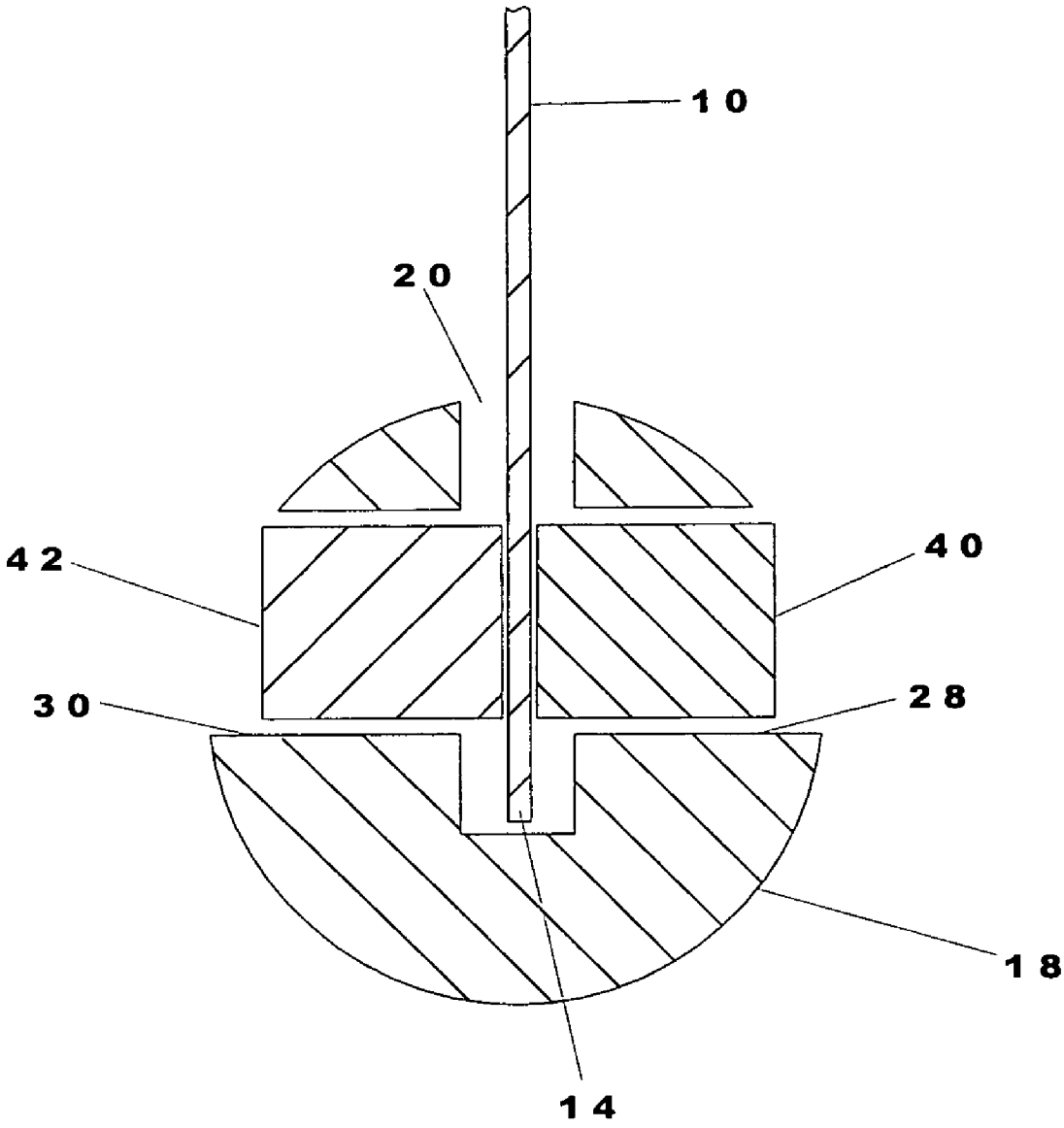
FIG. 4*a* is an enlarged, cross-sectional view of the second elongate member of FIG. 4.
Figure 5:
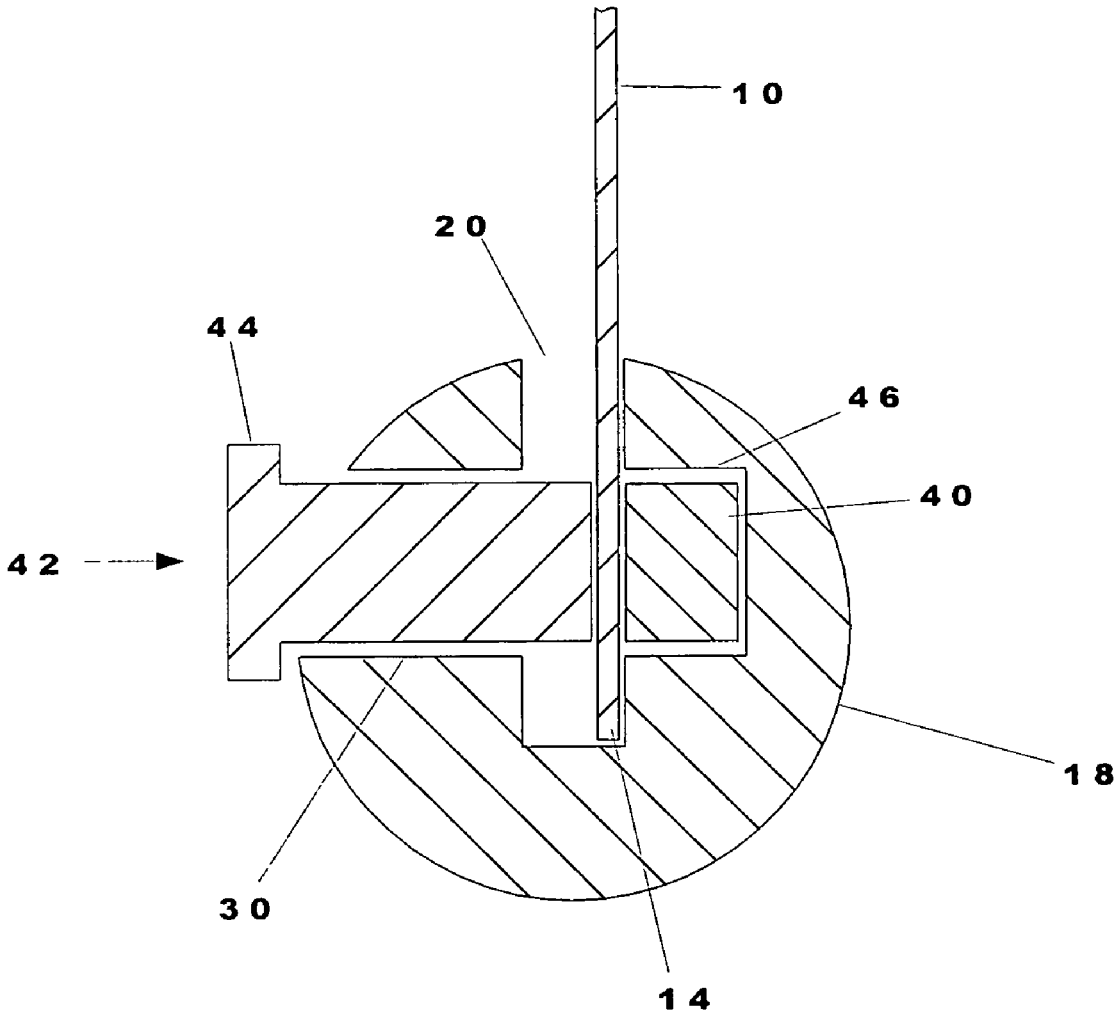
FIG. 5 is an enlarged, cross-sectional view of a third embodiment of the retaining means.
Figure 6:
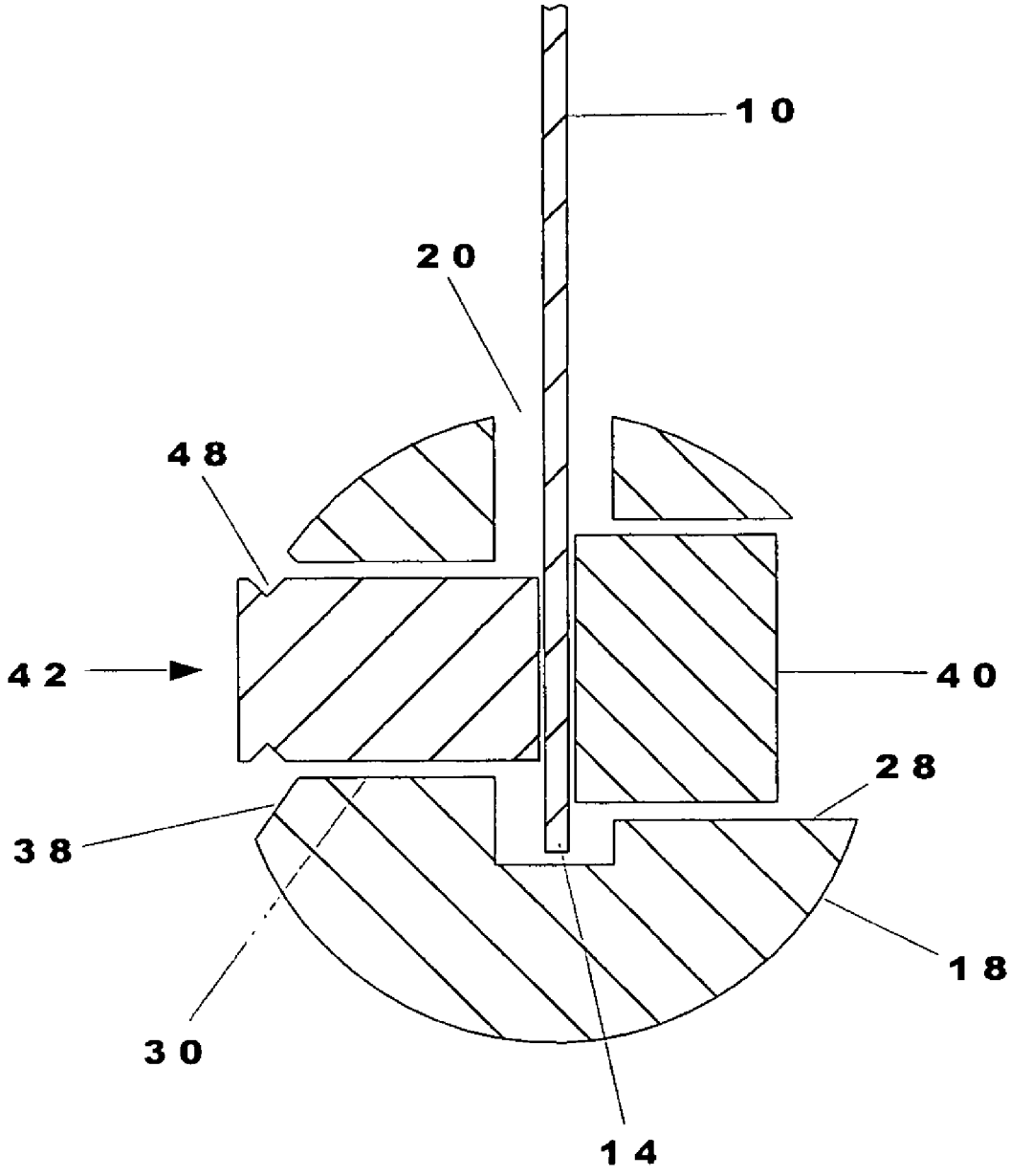
FIG. 6 is an enlarged, cross-sectional view of a fourth embodiment of the retaining means.

FIGS. 4 through 6 illustrate alternative embodiments of the retaining means of the present invention. In FIGS. 4 and 4*a*, the diameters of the magnet 40 and magnetic pin 42 are the same, and the diameters of the first well 28 and second well 30 are the same. In this embodiment, the sheet-like display item 10 is removed by pulling the display item 10 from the channel 20. The magnet 40 and magnetic pin 42 are held securely within the wells 28 and 30 while the display item 10 is pulled from the channel 20. After the sheet-like display item 10 has been removed, the magnet 40 and magnetic pin 42 may then be extracted from the wells 28 and 30. In another embodiment, as shown in FIG. 5, the well 28 is replaced with a blind well 46 in which the magnet 40 is seated. In a variation of this embodiment, the magnetic pin 42 without the flange 44 may be seated within the blind well 46, and the magnet 40 inserted into the well 30. The magnet 40, or magnetic pin 42, may be secured within the blind well 46 with an adhesive such as an epoxy. In yet another embodiment, as shown in FIG. 6, a groove 48 replaces the flange 44 of the magnetic pin 42 and the second outer opening 38 of the well is chamfered to allow fingertip access to the groove 48 of the magnetic pin 42.

Figure 7:
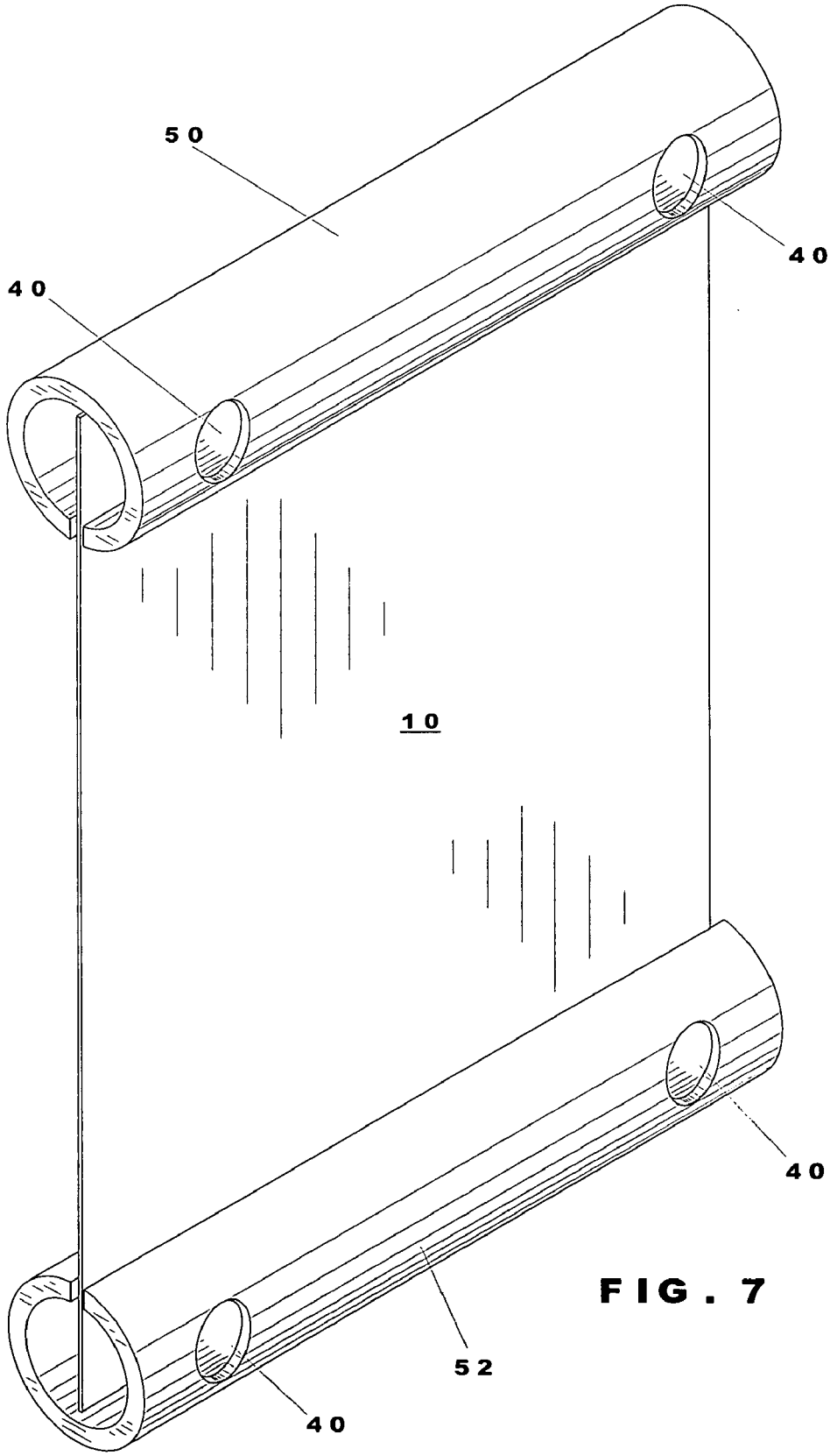
FIG. 7 is a perspective view of a fifth embodiment of the apparatus of the present invention.
Figure 8:
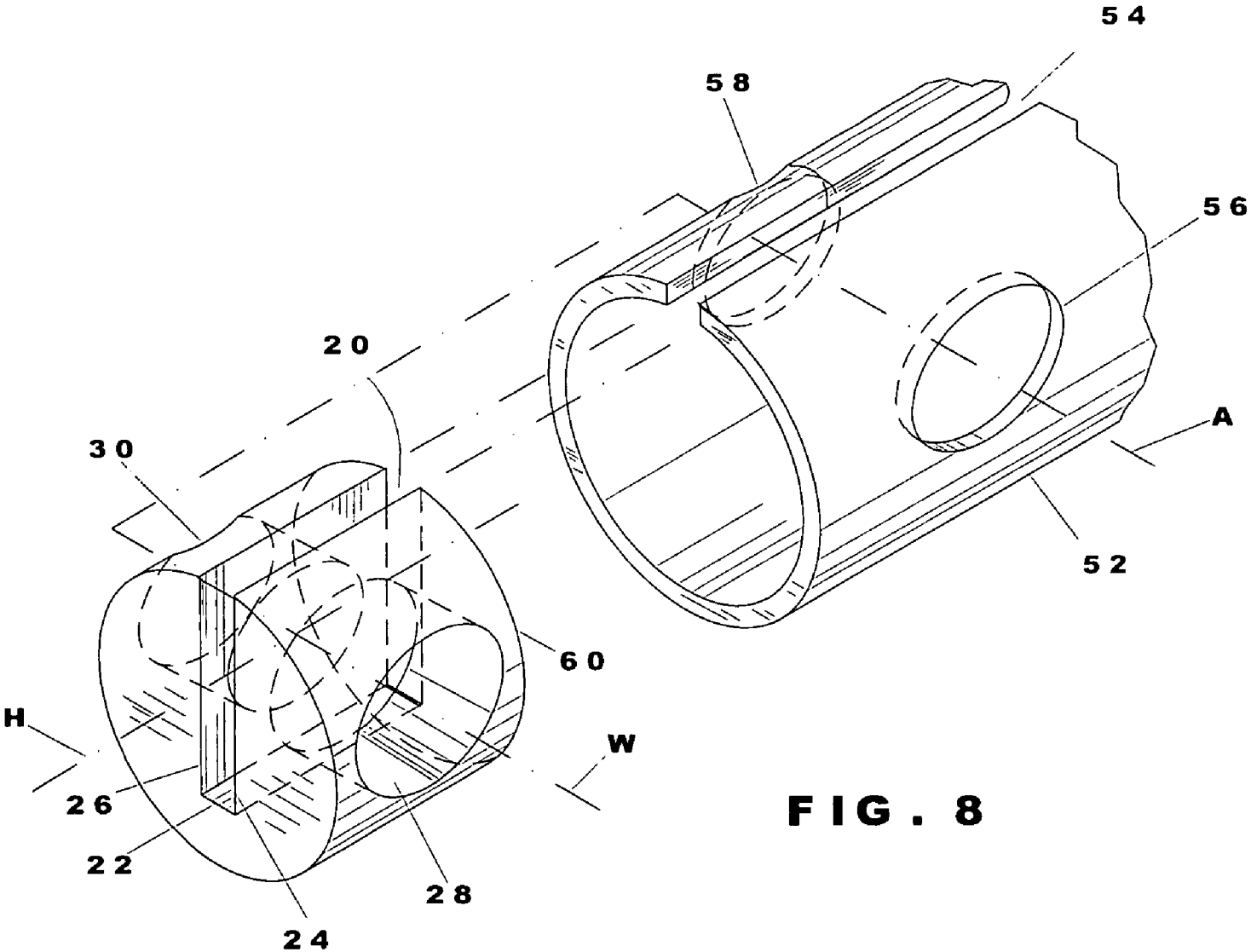
FIG. 8 is an enlarged, exploded perspective view, partially broken away, of the second elongate member of the apparatus of FIG. 7.

FIGS. 7 and 8 depict an alternative embodiment of the present invention in which the first elongate member 50 and second elongate member 52 are hollow. The first and second hollow elongate members 50 and 52 have the same configuration, but are inverted with respect to each other. Accordingly, the following detailed description of the second hollow elongate member 52 also applies to the first hollow elongate member 50. As shown in FIG. 8, the second hollow elongate member 52 has a longitudinally extending slot 54, and a first aperture 56 and a second aperture 58 coaxially positioned with their central axis A generally perpendicular to the plane of the slot 54. To accommodate the retaining means described above, a housing 60 is disposed within the second hollow elongate member 52 wherein the housing 60 mates with the interior of the second hollow elongate member 52. The housing 60 has a generally U-shaped channel 20 that is formed by a web 22 from which first and second sides 24 and 26 extend. The housing 60 also has a first well 28 and a second well 30, both generally cylindrical in shape. The wells 28 and 30 are positioned coaxially within the housing 60 such that the central axis W of the wells 28 and 30 is transverse to the central axis H of the housing and perpendicular to the sides 24 and 26 of the channel 20. When the housing 60 is disposed within the second hollow elongate member 52, the opening of the channel 20 registers with the slot 54, and the wells 28 and 30 register with the first and second apertures 56 and 58, respectively. The housing 60 may be secured within the hollow elongate member 52 with a conventional adhesive or a mechanical means such as a set screw. As described in detail with respect to the first embodiment above, the retaining means for captively retaining the edge 14 of the sheet-like display item 10 includes the magnet 40 and the magnetic pin 42. The various alternative embodiments of the retaining means described above also may be used with the embodiment shown in FIGS. 7 and 8. The hollow elongate members and housing may be formed from a variety of materials such as wood, metal, or plastic. The outer profile, as well as the inner profile, of the hollow elongate members 50 and 52 may be varied, e.g., round, square, etc.

A resilient and non-skid material, e.g., rubber, cork, neoprene, or vinyl, may be applied to the magnet 40 and magnetic pin 42 to enhance the ability of the retaining means to captively retain and protect the edges 12 and 14 of the sheet-like display item 10 within the channels 20 of the elongate members 16 and 18. Alternatively, the magnet 40 and/or magnetic pin 42 may be modified, e.g., scored or provided with a pointed tip, to facilitate retention of the sheet-like display item. While a cylindrical shape is the preferred profile for the wells, magnet and magnetic pin, other profiles, e.g., square, may be employed for these elements of the present apparatus for framing and hanging a sheet-like display item. In addition, the magnetic pin 42 may be replaced with another magnet 40.

The lengths of the first and second elongate members 16, 18, 50, and 52, and the number of retaining means may vary according to the size of the sheet-like display item 10. For relatively narrow display items, a single retaining means centrally positioned in each elongate member may be sufficient for captively retaining the edges of the sheet-like display item 10. For wider display items, two retaining means positioned in the elongate members near the corners of the sheet-like display item 10 may be employed. Additional retaining means may be added and positioned appropriately in the elongate members as required by the width and/or weight of the sheet-like display item 10. As an additional feature of the present invention, weight may be added to the elongate members to facilitate a tensioning of the sheet-like display item 10 thereby smoothing the surface of the display item and enhancing the stability of the apparatus against disruption by wind or vibration.

Figure 9:
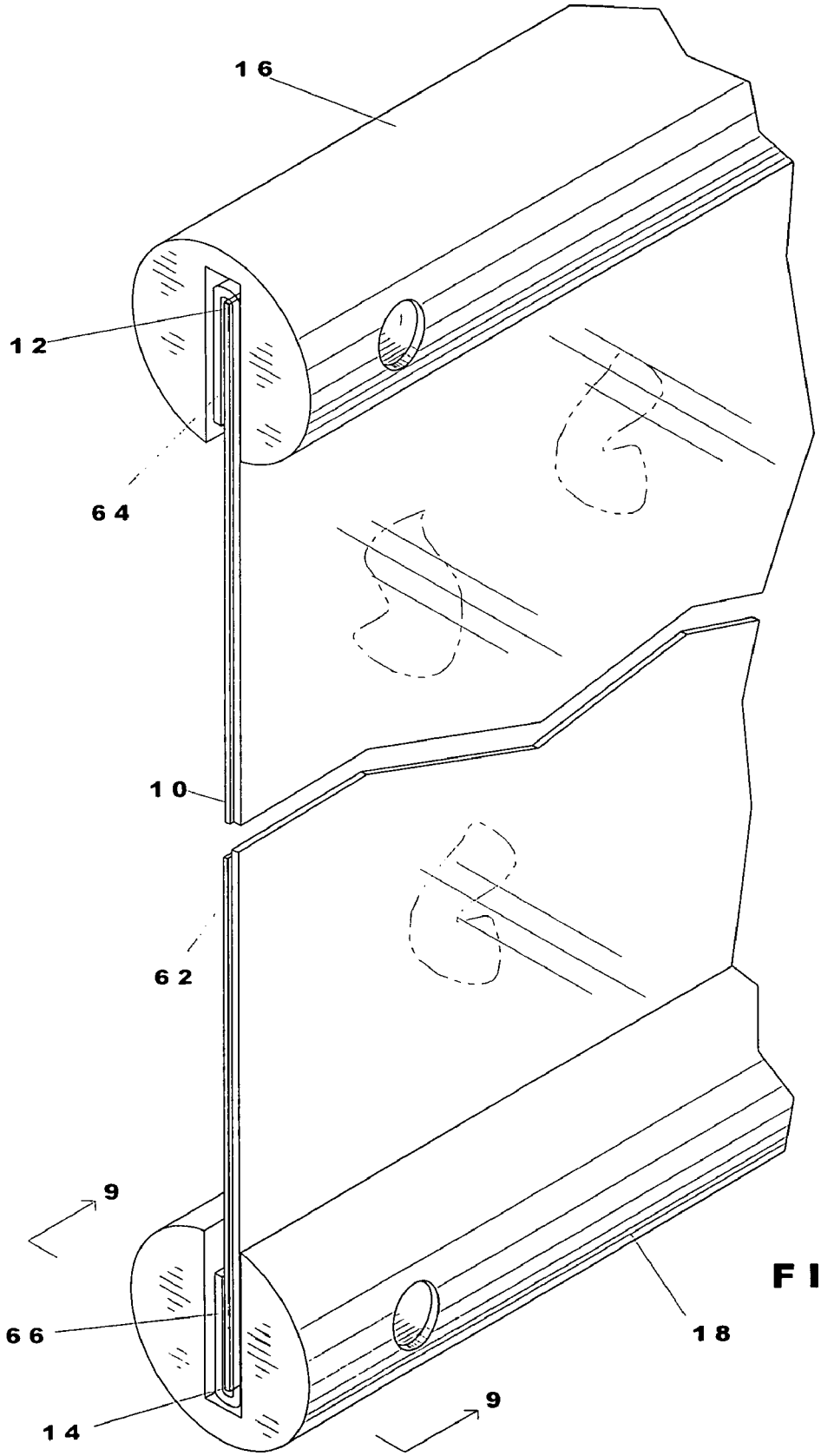
FIG. 9 is a perspective view, partially broken away, of the apparatus for framing and hanging a sheet-like display item in accordance with the invention, including a front-cover member.
Figure 9A:
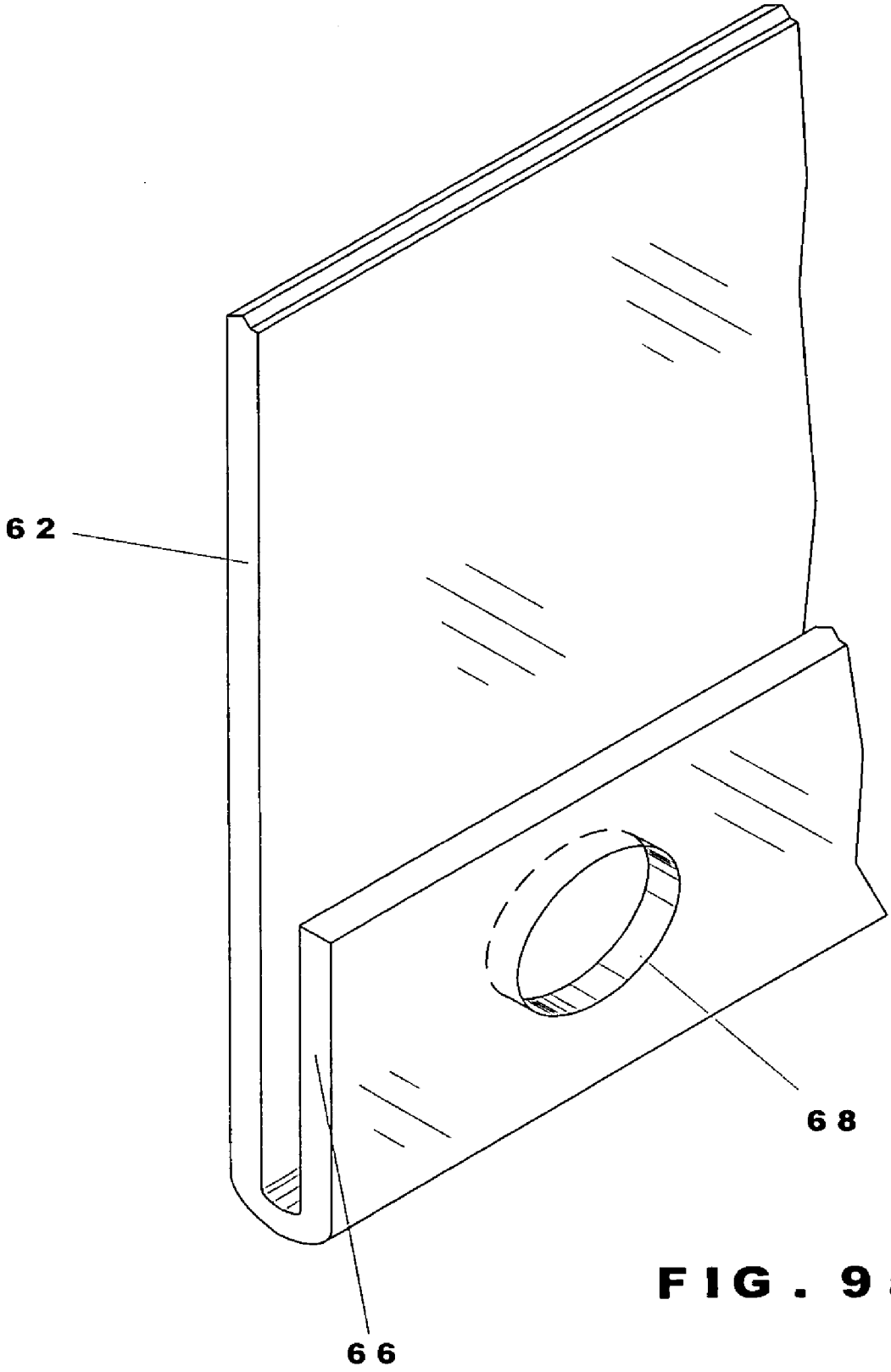
FIG. 9*a* is an enlarged, rear perspective view, partially broken away, of a corner of the front-cover member of FIG. 9.
Figure 9B:
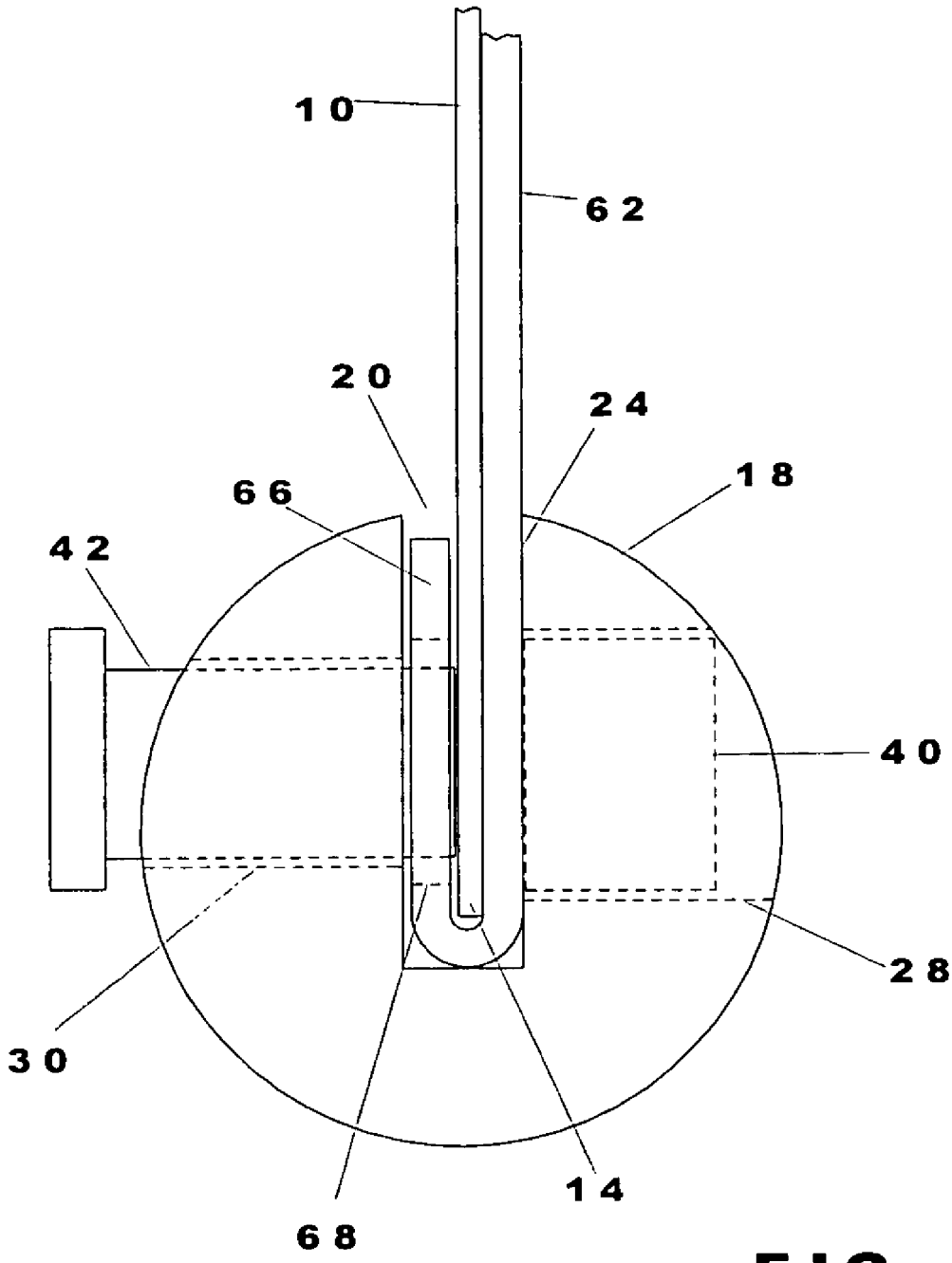
FIG. 9*b* is an enlarged, side view of the second elongate member of FIG. 9, viewed along line 9-9 of FIG. 9, illustrating the front-cover member of FIG. 9*a*.
Figure 9C:
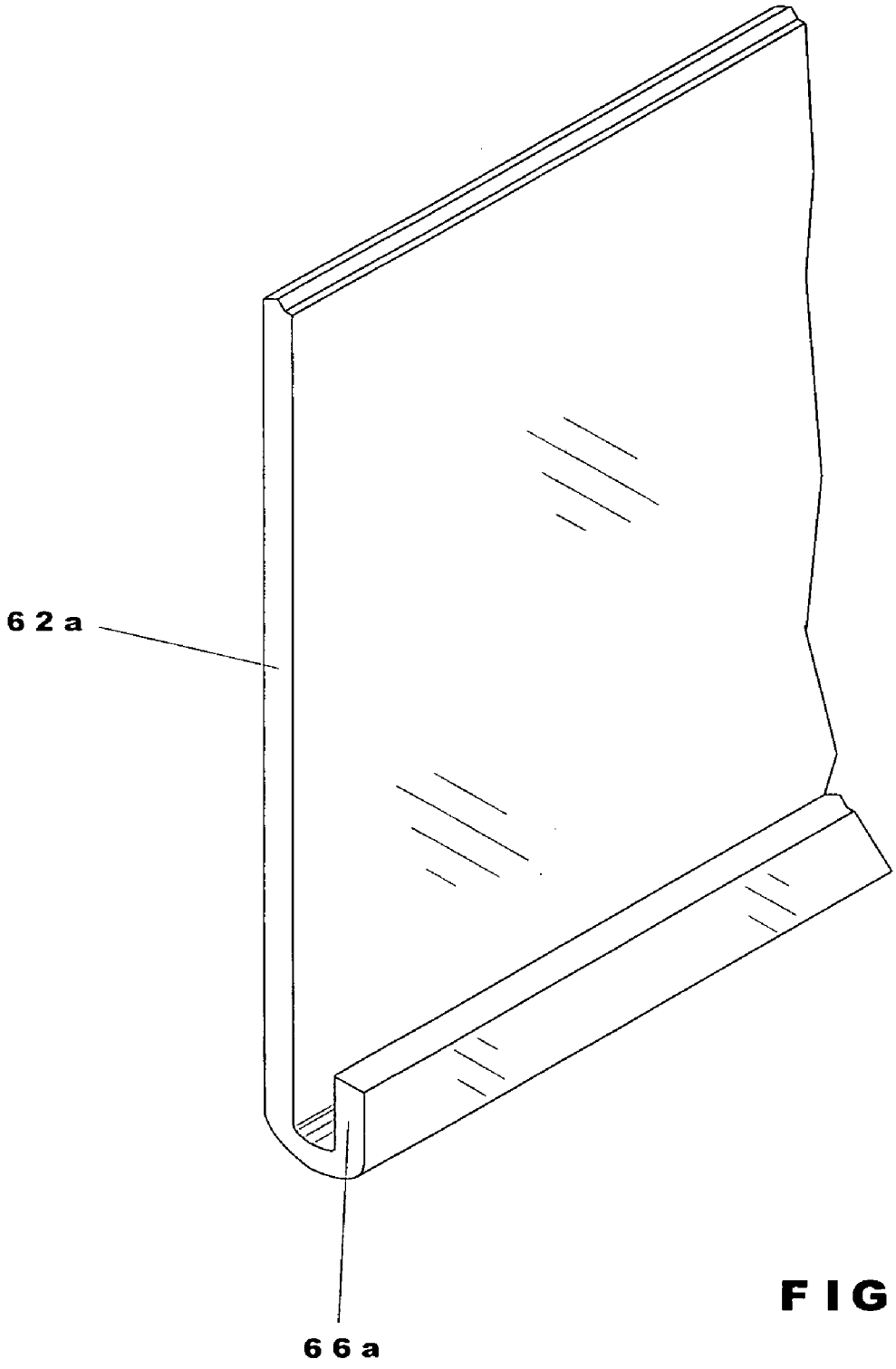
FIG. 9*c* is an enlarged, rear perspective view, partially broken away, of a corner of another embodiment of the front-cover member of FIG. 9.
Figure 9D:
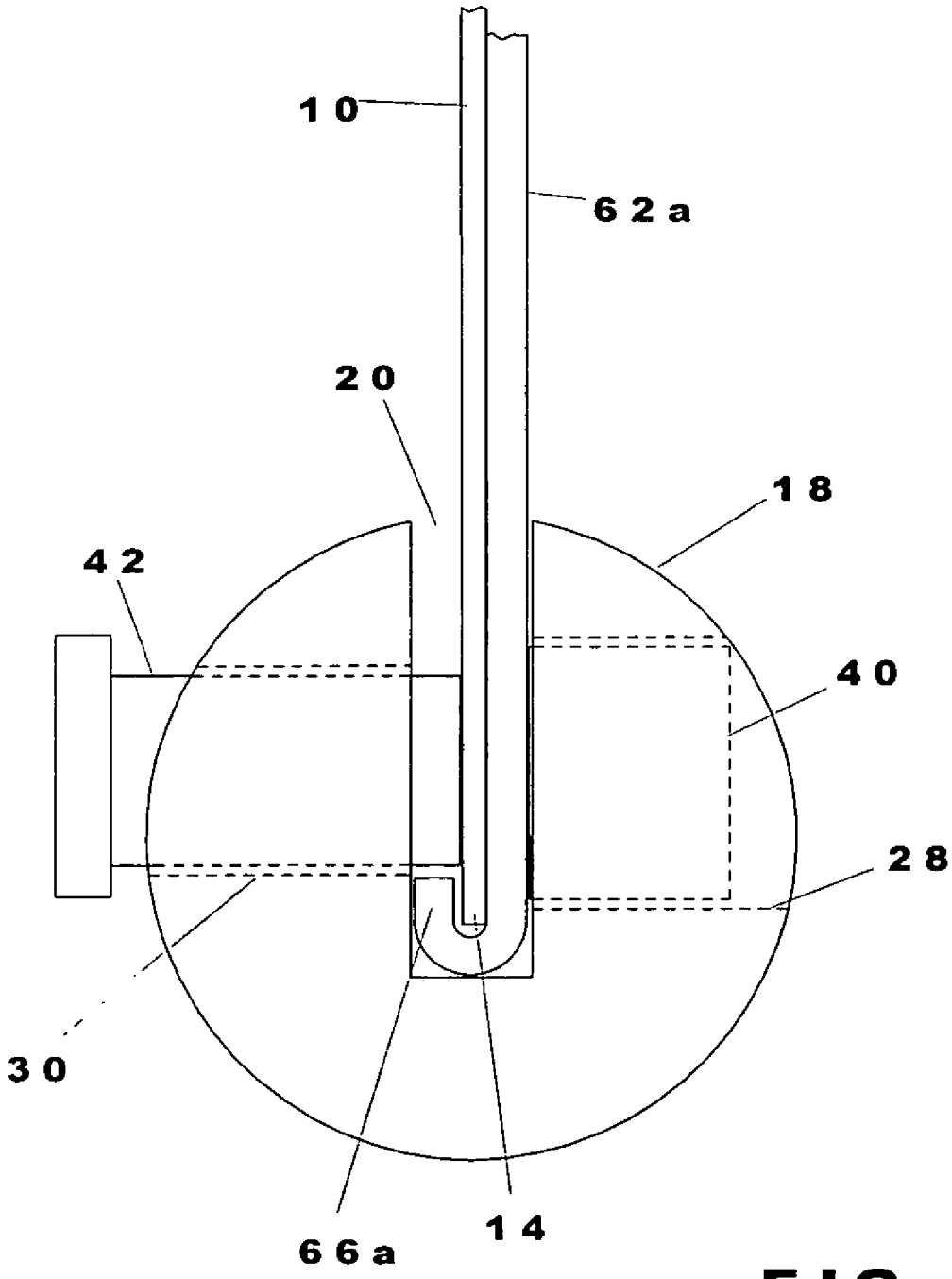
FIG. 9*d* is an enlarged, side view of the second elongate member of FIG. 9, viewed along line 9-9 of FIG. 9, illustrating the front-cover member of FIG. 9*c*.
Figure 9E:
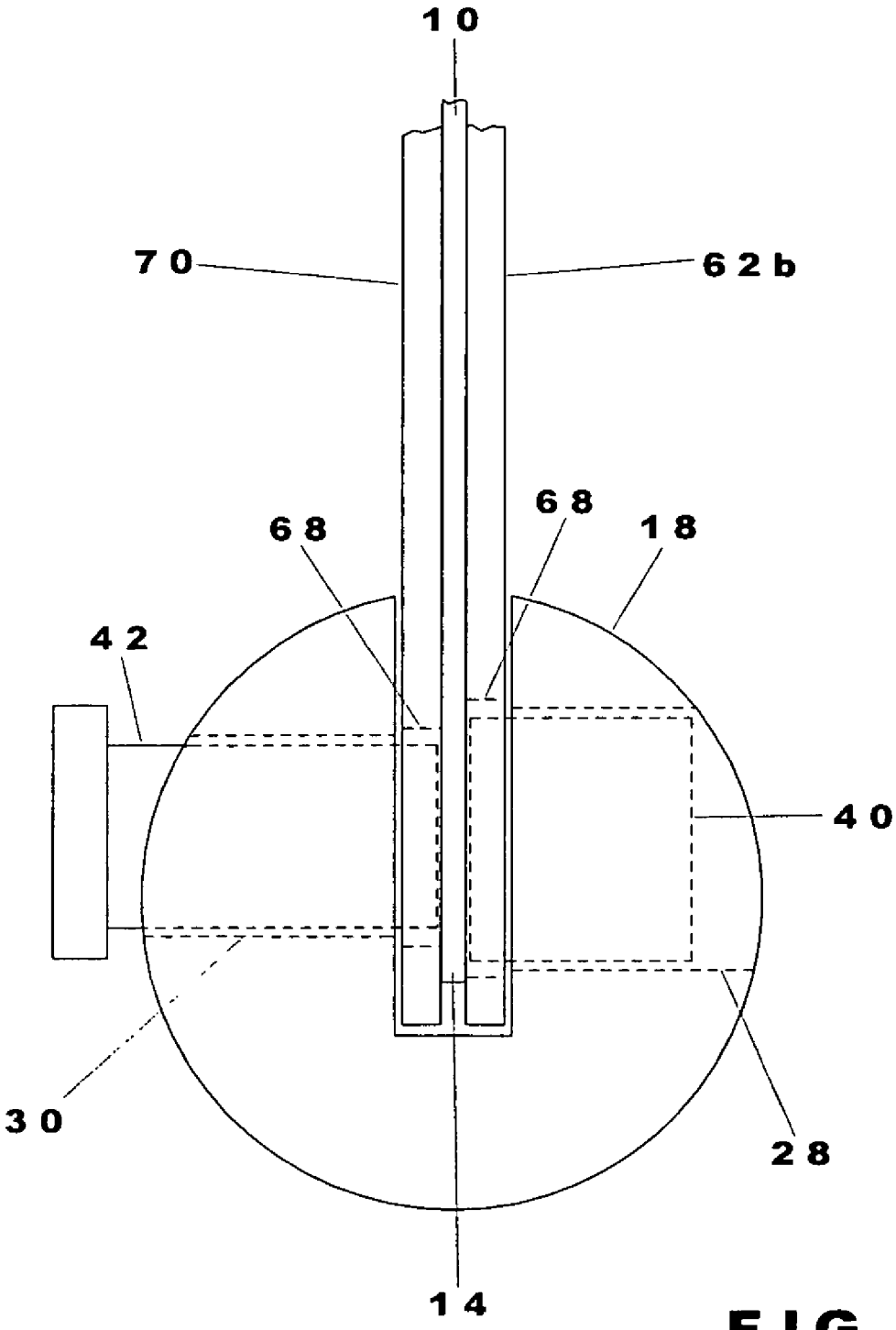
FIG. 9*e* is an enlarged, side view of the apparatus for framing and hanging a sheet-like display item in accordance with the invention, including front- and back-cover members.

The present apparatus for framing and hanging a sheet-like display item may further include a front-cover member 62 that provides additional support and protection to the sheet-like display item 10. FIGS. 9, 9*a*, 9*b*, 9*c* and 9*d* illustrate an embodiment of the front-cover member 62 having a top return 64 and a bottom return 66. The front cover member 62 is sized so that it generally covers the sheet-like display item 10 with the top return 64 surrounding the top edge 12 and the bottom return 66 surrounding the bottom edge 14 of the sheet-like display item 10. The following descriptions of the second elongate member 18 and bottom return 66 also applies to the first elongate member 16 and top return 64. As shown in FIG. 9*a*, the bottom return 66 of the front-cover member 62 is provided with one or more cover member openings 68 that are positioned to correspond with the wells that are disposed in the elongate members. Accordingly, when a magnet 40 and a magnetic pin 42 are inserted into their respective wells 28 and 30, the magnetic pin 42 may pass through the cover member opening 68 to press the edge 14 of the sheet-like display item 10 and the front-cover member 62 against the first side 24 of channel 20 due to the attraction of the magnet 40, thereby captively retaining the edge 14 and front-cover member 62 within the elongate member 18. In addition, since the magnetic pin 42 passes through the cover member opening 68 of the front-cover member 62 and may engage an inner edge of the opening 68, the retaining means may more securely retain the combination of the sheet-like display item 10 and front-cover member 62 within the channel 20. FIGS. 9*c* and 9*d* show another embodiment of the front-cover member 62*a* wherein the bottom return 66*a* does not extend past the well 30. Accordingly, while a cover member opening 68 is not required in this embodiment, the magnetic pin 42 may engage the edge of the bottom return 66*a* to secure the combination of the sheet-like display item 10 and front-cover member 62*a* within the channel 20. FIG. 9*e* shows another embodiment where a front-cover member 62*b*, which is formed without the returns, is used in conjunction with a back-cover member 70. Both the front-cover member 62*b* and the back-cover member 70 are provided with cover member openings 68 that correspond to the location of the magnets 40 and magnetic pins 42. The front- and back-cover members 62, 62*a*, 62*b*, and 70 may be formed from glass, acrylic or some other similar substantially rigid, transparent material. The back-cover member 70 may also be formed from cardboard, mat board, or the like. Alternatively, front-cover member 62 may be formed from a flexible, transparent material.

Figure 10:
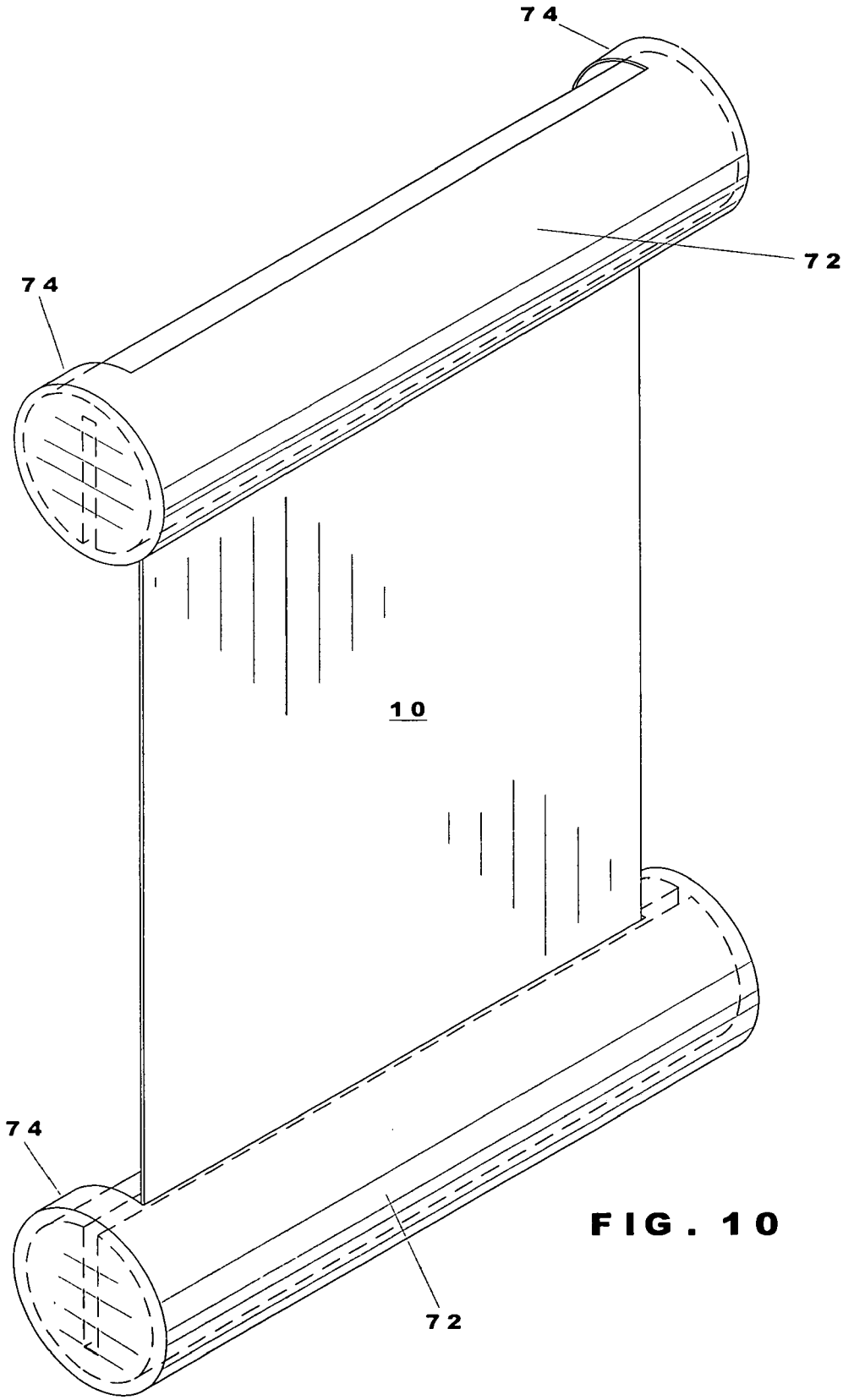
FIG. 10 is a perspective view of the apparatus for framing and hanging a sheet-like display item including an elongate member sheath.
Figure 11:
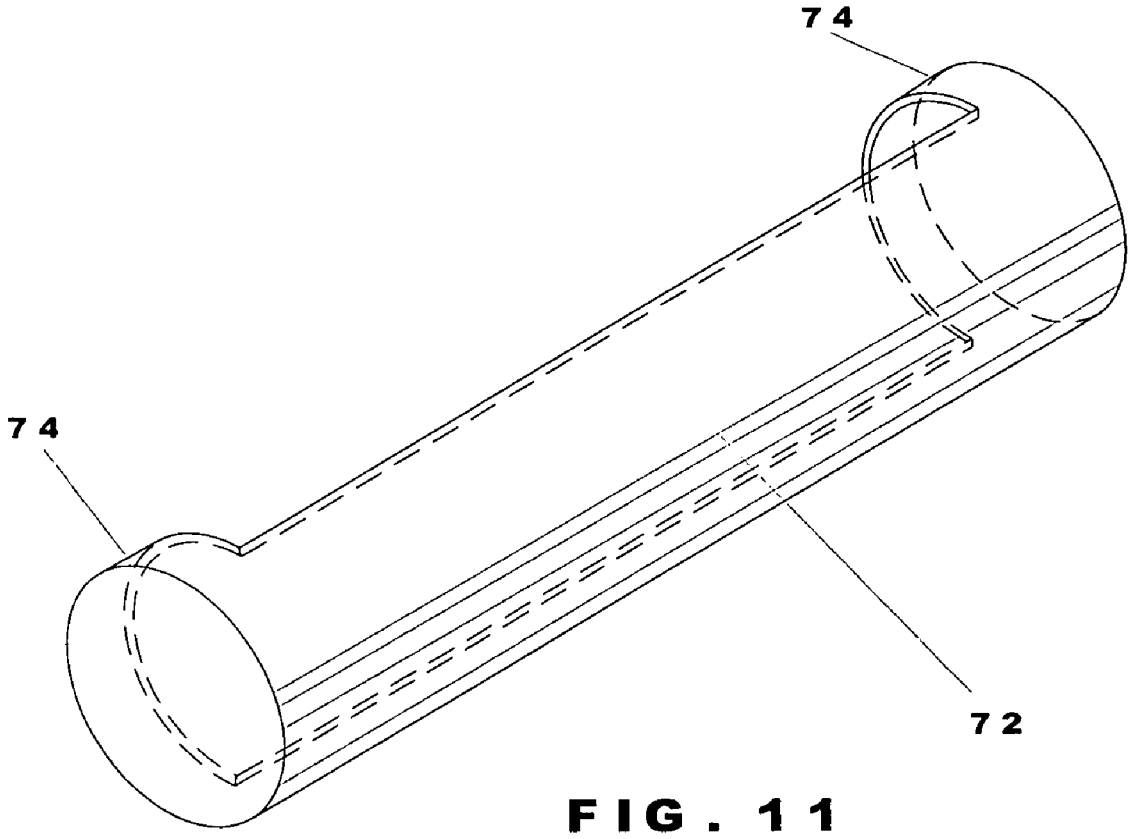
FIG. 11 is a perspective view of the elongate member sheath of FIG. 10.

To provide different decorative features on the framing and hanging apparatus, one or both of the elongate members may be enclosed with an elongate member sheath 72 having a plurality of cuffs 74, as shown in FIGS. 10 and 11. The sheath may be applied to the elongate members 16 and 18 by inserting one end of an elongate member into a cuff 74 of the elongate member sheath 72, and then bringing the other cuff 74 over the other end of the elongate member. A variety of materials, e.g., cloth, leather, plastic, or faux fur, may be used to form the elongate member sheath 72. In addition, finials, of which the outer profile may be varied, may be added to the ends of the elongate members for added weight, as mentioned above, and for added decorative features. The framing and hanging apparatus of the present invention may be mounted or hung from ceilings or walls in a conventional manner. For example, the first elongate member 16 or first hollow elongate member 72 may be provided with a hole for hanging the assembly upon a nail or hook. Alternatively, the assembly may be hung by a wire or string that may be run through the channel 20.

The above description of the present invention is susceptible to various modifications, changes and adaptations, and the same are intended to be comprehended within the meaning and range of equivalents of the following claims.

I claim:

1. An apparatus for framing and hanging a sheet display item, the apparatus comprising:

(a) first and second generally identical elongate members, each member having a central axis, and a longitudinally extending channel, formed by a web from which first and second sides extend, for receiving an edge of the sheet display item and;

(b) first and second wells, each well having a central axis, disposed within each member wherein the central axis of each well is transverse to the central axis, of the member and perpendicular to the channel, of the respective member in which the first and second wells reside, and the diameter of the first well is larger than the diameter of the second well; and (c) a magnet disposed within the first well and a magnetic pin disposed within the second well wherein the magnet is larger than the diameter of the second well.

2. An apparatus for framing and hanging a sheet display item, the apparatus comprising (a) first and second generally identical elongate members, each member having a central axis, and a longitudinally extending channel, formed by a web from which first and second sides extend, for receiving an edge of the sheet display item;

(b) first and second wells, each well having a central axis, disposed within each elongate member wherein the central axis of each well is transverse to the central axis, and perpendicular to the channel, of the respective member in which the first and second wells reside; and (c) a magnet disposed within each well.

3. An apparatus for framing and hanging a sheet display item, the apparatus comprising:

(a) first and second generally identical elongate members, each member having a central axis, and a longitudinally extending channel formed by a web from which first and second sides extend, for receiving an edge of the sheet display item;

(b) first and second wells, each well having a central axis, disposed within each elongate member wherein the central axis of each well is transverse to the central axis, and perpendicular to the channel, of the member in which the first and second wells reside; and (c) a magnet disposed within the first well and a magnetic pin disposed in the second well.

* * * * *